US005732668A

United States Patent [19]

Di Stefano

[11] Patent Number: 5,732,668

[45] Date of Patent: Mar. 31, 1998

[54] SIAMESE PISTON ARRANGEMENT INTERNAL COMBUSTION ENGINE

[76] Inventor: Alfonso Di Stefano, 15032 Mack Ave., Grosse Pointe Park, Mich. 48230

[21] Appl. No.: 771,424

[22] Filed: Dec. 20, 1996

[51] Int. Cl.[6] ..... F02B 75/06

[52] U.S. Cl. ..... 123/52.4; 123/52.6

[58] Field of Search ..... 123/52.4, 52.6, 123/52.3, 51 B, 51 R, 51 A, 52.2

[56] References Cited

U.S. PATENT DOCUMENTS

| | | | |
|---|---|---|---|
| 2,097,742 | 11/1937 | Scott | 123/51 AA |
| 2,137,941 | 11/1938 | Helmore et al. | 123/52.3 |
| 3,537,437 | 11/1970 | Paul et al. | 123/52.4 |
| 3,635,596 | 1/1972 | Richter | 417/459 |
| 3,805,752 | 4/1974 | Cataldo | 123/52.4 |
| 4,079,705 | 3/1978 | Buchner | 123/53 B |
| 4,170,970 | 10/1979 | McCandless | 123/52.4 |
| 4,453,898 | 6/1984 | Leka et al. | 417/512 |
| 4,964,379 | 10/1990 | August | 123/51 B |
| 4,964,380 | 10/1990 | Kusche | 123/73 V |
| 5,216,927 | 6/1993 | Mandelia | 74/51 |
| 5,435,232 | 7/1995 | Hammerton | 92/140 |
| 5,467,687 | 11/1995 | Habegger | 92/165 R |

FOREIGN PATENT DOCUMENTS

| | | | |
|---|---|---|---|
| 0343093 | 11/1989 | European Pat. Off. | 123/52.2 |

*Primary Examiner*—David A. Okonsky
*Attorney, Agent, or Firm*—Bliss McGlynn, P.C.

[57] ABSTRACT

The present invention provides an internal combustion engine using one or more siamese pairs of pistons, cylinders and connecting rods to drive two or more independently moving drive shafts. The pairs of pistons first connect to a stabilizing system that forces the piston to move in a generally linear direction perpendicular to the cylinder walls. The stabilizing mechanism is controlled by a set of gears or other guiding mechanism. A pair of hinged connecting arms are connected to the two independently moving drive shafts. The separate connecting arms track the angular motion of the drive shafts while allowing the pistons to move in a generally linear direction perpendicular to the cylinder walls.

14 Claims, 5 Drawing Sheets

SIAMESE PISTON ARRANGEMENT INTERNAL COMBUSTION ENGINE

FIELD OF THE INVENTION

The present invention relates to internal combustion engines generally and, more particularly, to an internal combustion engine using pistons arranged in siamese pairs to drive two or more independent drive shafts.

BACKGROUND OF THE INVENTION

Internal combustion engines are used in a wide variety of applications relating to transportation, generation of electricity and other industrial applications. A chamber is generally filled with a combustible gas which is ignited causing a piston to move inside a cylinder in a direction outward from the direction of the ignition. A connecting rod is generally used to transfer the energy from the piston to a drive shaft. The drive shaft is then used to perform work such as turning an electrical generator or driving the wheels of an automobile. As the crank shaft turns, the piston oscillates between two positions. As a result, the connecting rods generally move from side to side about the rotation of the drive shaft. This side to side motion causes stresses in the cylinder, the piston and between the piston rings and the cylinder wall. To compensate for these stresses, previous approaches have extended the height of the piston in order to provide a greater surface area in contact between the piston and the cylinder wall. As a result, the side to side forces are reduced, but at the expense of greater friction and additional wear on the piston rings.

Certain pervious approach engines, such as U.S. Pat. No. 5,435,232, have shown a single piston connected to two or more connecting rods. However, such an arrangement does not provide the benefits of the present invention such as reducing the side to side forces, reducing friction and reducing additional wear on the piston rings. Other such previous approaches are generally limited to a single piston driving one or more connecting rods.

SUMMARY OF THE INVENTION

The present invention provides an internal combustion engine using one or more siamese pairs of pistons, cylinders and connecting rods to drive two or more independently moving drive shafts. The pairs of pistons first connect to a stabilizing system that forces the piston to move in a generally linear direction perpendicular to the cylinder walls. The stabilizing mechanism is controlled by a set of gears or other guiding mechanism. A pair of hinged connecting arms are connected to the two independently moving drive shafts. The separate connecting arms track the angular motion of the drive shafts while allowing the pistons to move in a generally linear direction perpendicular to the cylinder walls.

Objects, features and advantages of the present invention include providing an internal combustion engine that reduces the wear present on the piston rings, reduces the amount of area of a piston ring that needs to be in contact with the cylinder wall, provides a generally linear motion of the pistons in a direction perpendicular to the cylinder walls, drives two or more independently rotating drive shafts, reduces the overall size of the engine, increases the overall efficiency of the engine and improves the overall performance of the engine.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENT

Figure 1:
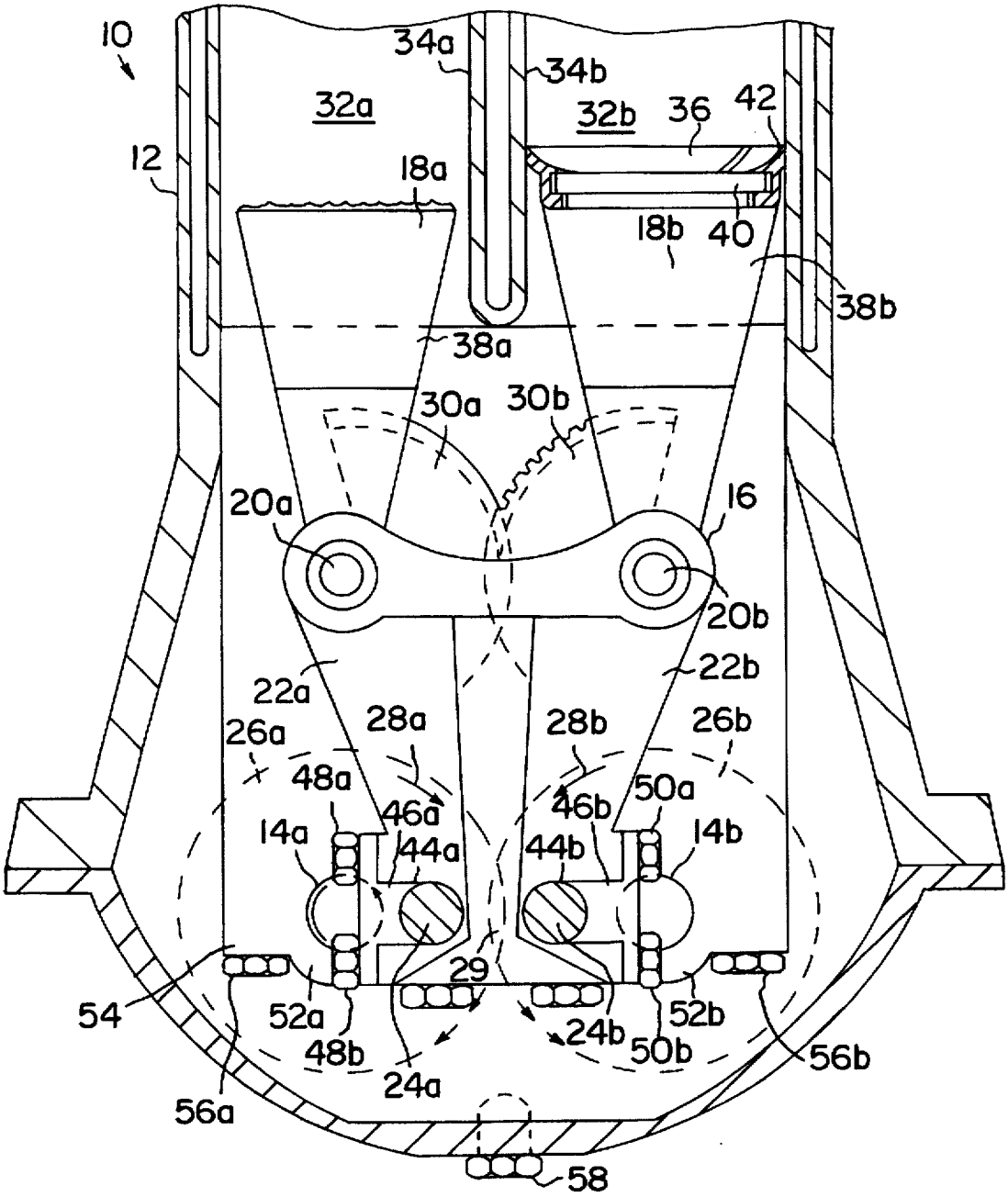
FIG. 1 is a cross sectional view of the preferred embodiment of the present invention.

Referring to FIG. 1, an engine 10 is shown in accordance with a preferred embodiment of the present invention. The engine 10 generally comprises a housing 12, a first drive shaft **14*a*, a second drive shaft 14*b*, a stabilizer 16, a first piston 18*a* and a second piston 18*b*. The pistons 18*a* and 18*b* are connected to a pair of pivots 20*a* and 20*b* formed on either end of the stabilizer 16. A set of pivoting connecting arms 22*a* and 22*b* are connected between the pivots 20*a* and 20*b* and the drive shafts 14*a* and 14*b*. The pivoting connecting arms 22*a* and 22*b* generally correspond to a conventional connecting rod. The drive shafts 14*a* and 14*b* generally have a set of lobes 24*a* and 24*b* which are located generally about the drive shafts 14*a* and 14*b* creating a moment which allows the drive shafts to turn. The connecting arms 22*a* and 22*b* are connected to the lobes 24*a* and 24*b* respectively. The lobes 24*a* and 24*b*** generally correspond to a conventional crank through pin.

Each drive shaft **14*a* and 14*b* has a geared disk 26*a* and 26*b* that are located generally circumferentially about the drive shafts 14*a* and 14*b*. The geared disks 26*a* and 26*b* are located on each side of the lobes 24*a* and 24*b* and are interlocked at a portion 29. The disk 26*a* rotates about the drive shaft 14*a* in a direction generally indicated by the arrow 28*a*. Similarly, the disk 26*b* rotates about the drive shaft 14*b* in a direction indicated generally by the arrow 28*b*. The lobe 24*a* rotates about the drive shaft 14*a* at the same approximate rotational distance as the lobe 24*b* rotates about the drive shaft 14*b*. As a result, the forces received from the stabilizer 16 are balanced about the rotation of the drive shafts 14*a* and 14*b*. This balancing reduces the overall vibration of the engine 10. As a result of the reduced vibration, less overall stress is placed on the engine 10** resulting in a longer useful life.

The stabilizer 16 also connects to the pistons **18*a* and 18*b* and forces the pistons to move in a generally linear direction. The pivot 20*a* is connected to a gear 30*a* while the pivot 20*b* is connected to a gear 30*b*. The gears 30*a* and 30*b*, along with the stabilizer 16, provide a guiding effect to force the piston to move in a generally linear direction. The gears 30*a* and 30*b* may be a bevel gear, a standard gear, a worm gear or any other type of gear required to fit the design criteria of a particular application. The gears 30*a* and 30*b* should provide a smooth path of travel for the stabilizer 16**.

The pistons **18*a* and 18*b* travel inside a cylinder 32*a* and 32*b* respectively. The cylinder 32*a* and 32*b* each have a cylinder wall 34*a* and 34*b* that produce an area for the pistons 18*a* and 18 *b* to travel. The piston 18*b* generally comprises a portion 36, a portion 38 and a portion 40. The portion 36 generally receives the physical force from the combustible gas and transfers the physical force to the portion 40. The portion 40 provides a section for the piston ring 42 to be mounted. The portion 38***b* is shown to be in a generally conical configuration. The conical configuration is illustrated to show a high strength implementation of the portion 38*b*. The portion 38*a*, 38*b* and the stabilizer 16 are generally made as one piece. Since one piece is realized, the strength of the stabilizer 16 is increased. A high strength implementation is desired since the force of the entire piston 18 is transferred through the portion 38 to the stabilizer 16. The piston ring 42 provides a seal between the piston 18 and the cylinder wall 34. Since the overall motion of the piston 18 is generally linear in a direction perpendicular to the cylinder wall 34, the stresses placed on the ring 42 are minimized. As a result, lower cost materials may be used to implement the ring 42 without sacrificing performance of the overall design. A lower cost ring 42 improves the overall production efficiency of implementing the engine 10.

A cylinder head (not shown) is generally required to be mounted on top of the cylinder wall 34*a* and the cylinder wall 34*b*. The cylinder head generally encompasses the cylinder and provides a chamber at the top of the cylinder for the ignition of the combustible gas. A cylinder head that creates either a single combustion chamber for both the cylinder 32*a* and 32*b* or a separate combustion chamber for the cylinder 32*a* and 32*b* may be implemented according to the design criteria of a particular application. An example of a single combustion chamber operating two independent pistons is shown in U.S. Pat. No. 4,964,379 which is hereby incorporated by reference.

The pivoting connecting arms 22*a* and 22*b* are connected to the lobes 24*a* and 24*b* by creating an opening 44*a* and 44*b*. The connecting point 24*b* is inserted into the opening 44*a* and is secured by a portion 46*a*. The portion 46*a* is secured by a pair of bolts 48*a* and 48*b*. It should be appreciated that other fastening means may be substituted for the bolts 48*a* and 48*b* according to the design criteria of a particular application. Similarly, the portion 46*b* is secured by a pair of bolts 50*a* and 50*b*.

The drive shafts 14*a* and 14*b* are secured in place by a portion 52*a* and 52*b*. The portions 52*a* and 52*b* are secured to a portion 54 by a pair of bolts 56*a* and 56*b*. An oil plug 58 is shown which may be removed to change the lubrication used in the engine 10.

Figure 2:
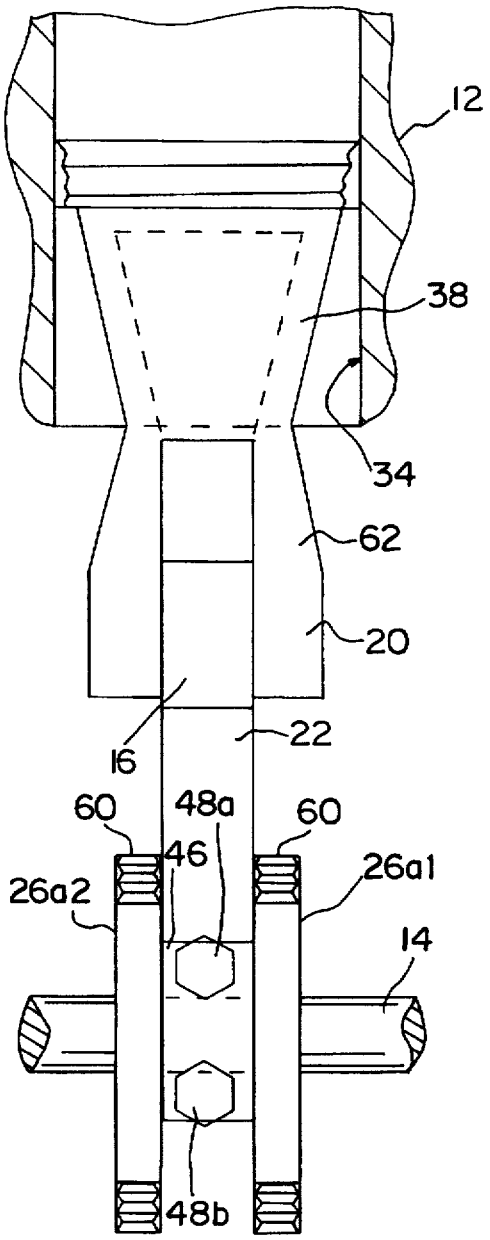
FIG. 2 is a side view of the embodiment of FIG. 1.

Referring to FIG. 2, a cross section of one of the pistons 18 is shown. The geared disk 26 is shown as two independent geared disks 26*a*1 and 26*a*2. The geared disks 26*a*1 and 26*a*2 are connected on either side of the pivoting connecting arm 22. Each of the geared disks 26*a*1 and 26*a*2 has a gear system cut into the outer circumference of the particular disk. This allows for the geared disks 26*a*1 and 26*a*2 to mesh with the geared disks 26*b*1 and 26*b*2 to provide further stability of the engine 10. It should be appreciated that the meshing of the geared disks 26*a*1 and 26*a*2 with the geared disks 26*b*1 and 26*b*2 is an optional feature that may be implemented to stabilize the engine 10. However, in particular design applications it may be desirable to eliminate the intermeshing of the geared disks 26*a*1 and 26*a*2 with the geared disks 26*b*1 and 26*b*2.

The piston 18 is shown having a portion 62 that forms a generally outward taper to encompass the stabilizer 16. The pivot 20 is generally included inside the portion 62. The portion 38 of the piston 18 is shown having an inward taper towards the portion 62. The inward taper of the portion 38 forms a generally triangular configuration that is used for a high strength and low cost implementation of the piston 18.

The drive shafts 14*a* and 14*b* may be used to drive independent functioning machines, such as separate wheels of an automobile, or may be combined using a gear box (not shown) to produce a single drive shaft having twice the power of the independent drive shafts 14*a* and 14*b*. It should be appreciated that in an automobile setting, the separate drive shafts may be used to drive the separate wheels of the automobile. This may eliminate the need for a gear box to transfer the energy from a single drive shaft to the separate wheels. In the particular automobile application, a limited slip differential may be necessary to prevent undue stresses on the engine 10.

Figure 3:
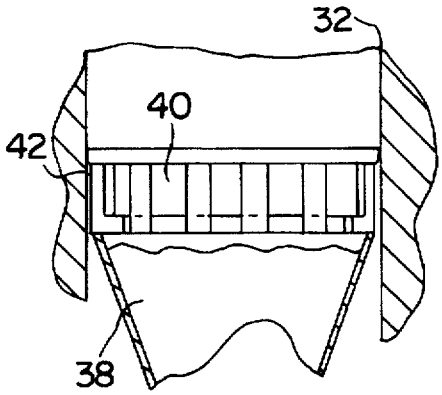
FIG. 3 is a more detailed view of a cross section of the piston rings.

Referring to FIG. 3, a cross sectional view of the cylinder 32 is shown. The portion 38 is shown connected to the portion 40. The portion 40 is surrounded by the piston ring 42.

Figure 4:
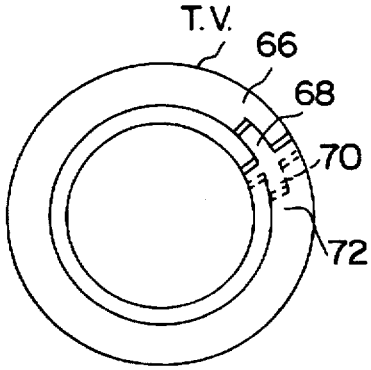
FIG. 4 is a top view of the piston rings of FIG. 3.

Referring to FIG. 4, a top view of the ring 42 is shown. The ring 42 is generally comprised of a first section 66 that interlocks with a second section 68. A second part of the ring is created having a first section 70 that interlocks with a second section 72. The interlocking of the first section 66 and the second section 68 is done in a portion of the ring offset from the interlocking of the first section 70 and the second section 72. The particular ring configuration provides a greater sealing affect between the piston 18 and the cylinder wall 34. However, conventional piston rings would generally benefit from the present invention as well.

Figure 5:
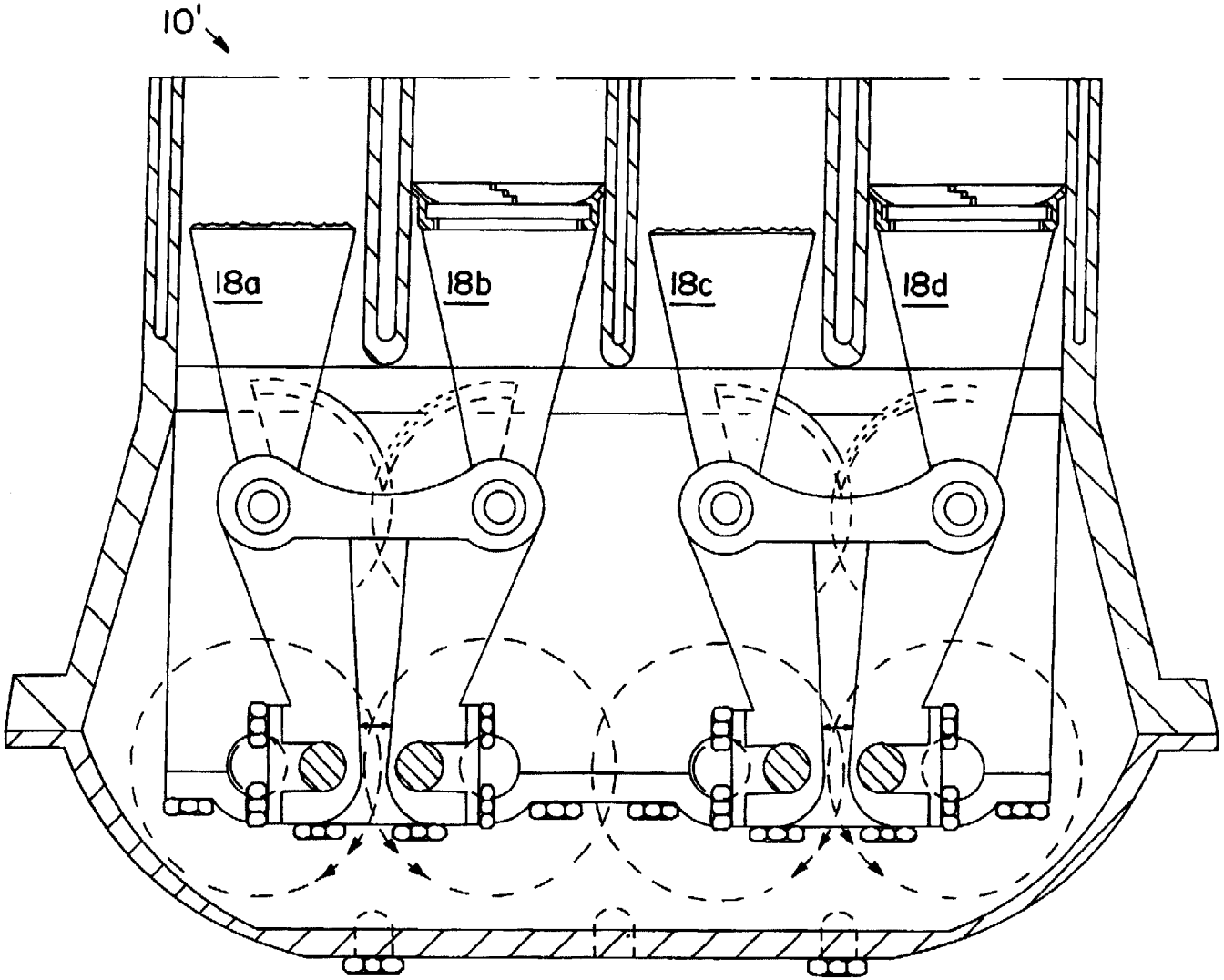
FIG. 5 is an alternate embodiment of the present invention illustrating four individual cylinders.

Referring to FIG. 5, an alternate embodiment of the engine 10' is shown. The alternate embodiment engine 10' encompasses four pistons 18*a*, 18*b*, 18*c* and 18*d*. The alternate embodiment engine 10' generally has four independent drive shafts 14*a*, 14*b*, 14*c* and 14*d*. Two of the drive shafts, for example, 14*a* and 14*c* are spinning in the same direction. The other two drive shafts, for example, 14*b* and 14*d*, are spinning in the generally opposite direction of the drive shafts 14*a* and 14*c*. As a result, the drive shafts 14*a* and 14*c* may be combined using a gear box to drive a first mechanical device while the drive shafts 14*b* and 14*d* may be combined using a second gear box to drive a second mechanical device. The advantages of the engine 10 are realized in the alternate embodiment engine 10' with the added advantage of an increased amount of power.

Figure 6:
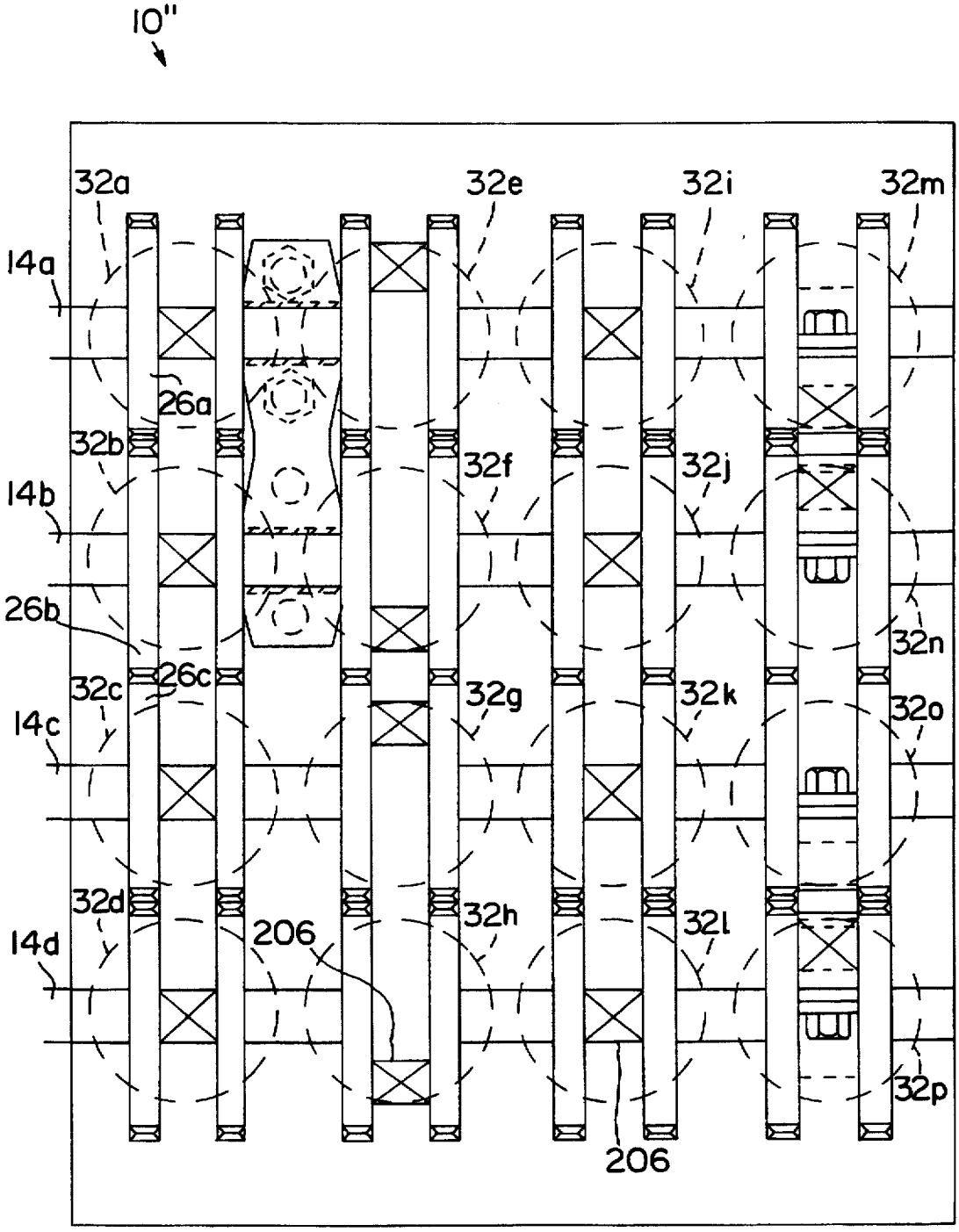
FIG. 6 is a second alternate embodiment of the present invention illustrating eight pairs of cylinders which roughly correspond to the workings of an eight cylinder engine.

Referring to FIG. 6, a second alternate embodiment 10" is shown. The second alternate embodiment 10" is shown having 16 independently functioning cylinders 32*a*~32*p*. Each of the cylinders 32*a*~32*p* functions in a similar fashion as the embodiments shown in FIG. 1 and FIG. 5. Specifically, pairs of cylinders, for example 32*a* and 32*b* work in combination with a single stabilizer 16 to provide the generally linear movement of the pistons 18. The added advantage of the alternate embodiment 10" is that the cylinders 32*a* and 32*b* also work in combination with the cylinders 32*c* and 32*d* to provide an additional stabilizing affect. Specifically, the geared disk 26*b* is shown as being meshed with the geared disk 26*c*. This allows the cylinders 32*a*~32*d* to work in combination to provide a smooth and stable running engine. The embodiment 10" produces four independently rotating drive shafts 14*a*~14*d*, which operate in a similar configuration as the embodiment 10'. However, the cylinders 32*a*, 32*e*, 32*i* and 32*m* each work on the drive shaft 14*a*. Similarly, the cylinders 32*b*, 32*f*, 32*j* and 32*n* work to turn the drive shaft 14*b*. The drive shaft 14*c* and 14*d* are similarly driven. The drive shaft 14*a* spins in a direction generally equal to the spinning of the drive shaft 14*c*. The drive shaft 14*b* spins in an opposite direction of the drive shaft 14*a* but in the same direction as a drive shaft 14*d*.

Figure 7:
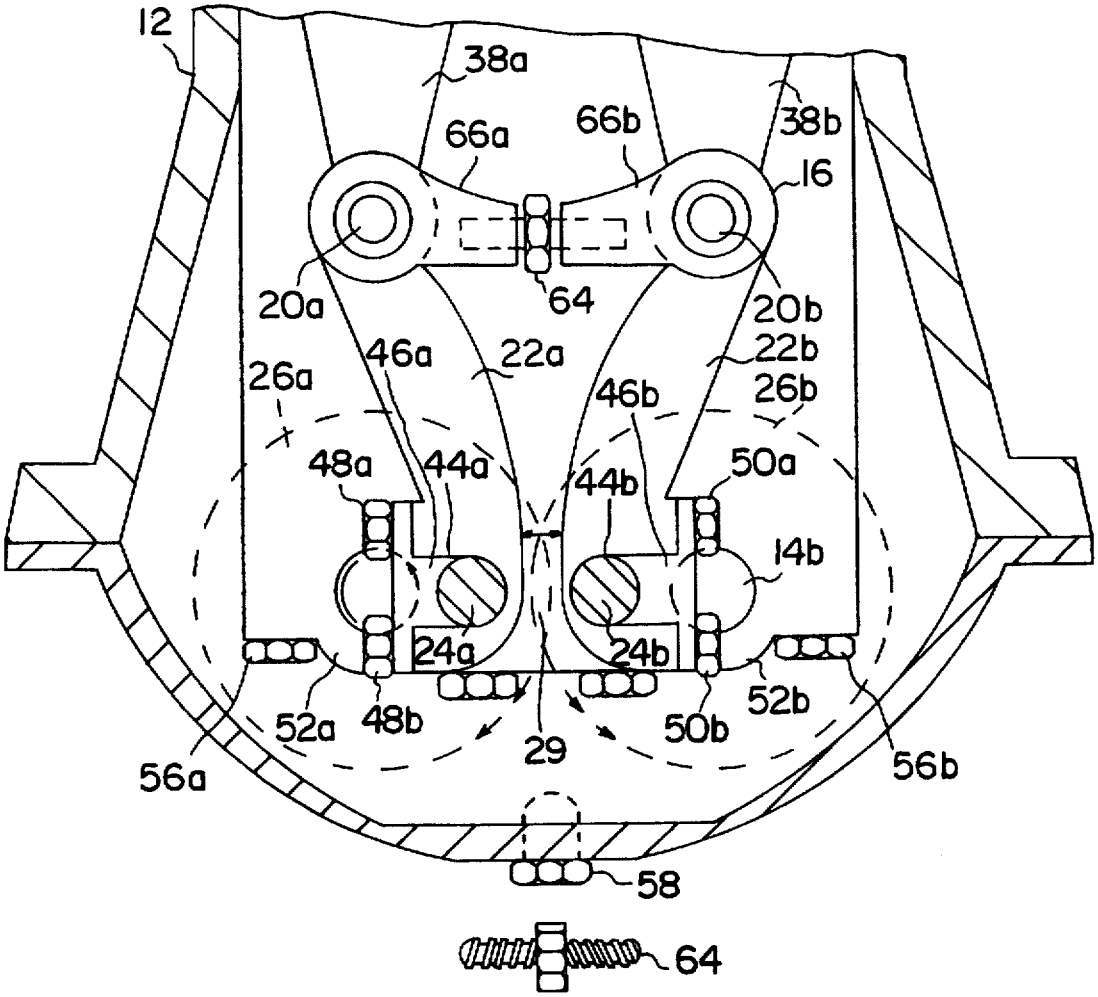
FIG. 7 illustrates an alternate embodiment of the stabilizer of the present invention.

Referring to FIG. 7, an alternate stabilizer 16 may include an adjustment screw 64 for calibrating the exact distance between the pivots 20a and 20b. The adjustment screw may allow the pistons 18a and 18b to be adjusted to the center of the respective cylinder walls 34a~34b by adjusting a first portion 66a and a second portion 66b. The adjustment screw 64 may be as simple as a screw connected between two halves of the first portion 66a and the second portion 66b of the stabilizer 16. However, other adjustment means may be implemented according to the design criteria of a particular application.

While the present invention has been described in an illustrative manner, it should be understood that the terminology used is intended to be in a nature of words of description rather than a limitation. For example, the stabilizer 16 of the present invention may be applied to a compressor or other piston oriented machine.

Furthermore, while the present invention has been described in terms of a preferred embodiment, it is to be appreciated that those skilled in the art will readily apply these teachings to other possible variations of the inventions.

I claim:

1. An internal combustion engine comprising:

at least one pair of cylinders formed in an engine block;

at least one pair of pistons each moving in a linear direction perpendicular to the inside of a respective one of said cylinders in response to energy forces in a respective chamber positioned at one end of each cylinder;

a stabilizer having a first and second end wherein each end is connected to a lower portion of each piston, said stabilizer includes a pair of gears, a respective one of said pair of gears connected to each end of said stabilizer and configured to engage each other to maintain said linear direction of movement of said pistons;

at least one pair of connecting arms each pivotally connected to a respective one of said first and second ends of said stabilizer; and a first drive shaft connected to a first connecting arm of said pair and a second drive shaft connected to a second connecting arm of said pair, wherein said first and second drive shafts transfer energy to one or more external devices.

2. The engine according to claim 1 wherein said pair of gears is selected from the group consisting of a worm gear and a bevel gear.

3. The engine according to claim 1 wherein said first drive shaft rotates in a first direction and said second drive shaft rotates in a second direction, wherein said first and second directions are opposite directions.

4. The engine according to claim 1 further comprising a pair of rings positioned around each piston for sealing and reducing wear between said piston and said cylinder.

5. The engine according to claim 1 wherein said pistons each comprise:

a top portion for transferring said energy to said stabilizer; and a ring portion for supporting one or more piston rings positioned around each piston for sealing and reducing wear between said piston and said cylinder.

6. The engine according to claim 1 wherein said pair of stabilizing portions are tapered in a conical configuration between said ring portion and said stabilizer.

7. The engine according to claim 1 wherein said first and second drive shafts each further comprise:

a disk surrounding said drive shafts; and a lobe connected to said disk for transferring said linear energy from said stabilizer into rotational energy at said drive shafts.

8. The engine according to claim 7 wherein the disk of said first drive shaft has a geared portion that is meshed with a geared portion of said second drive shaft.

9. The engine according to claim 1 wherein said energy forces are generated by combustible gas.

10. The engine according to claim 1 wherein said energy forces are generated by electricity.

11. An internal combustion engine comprising:

at least one pair of cylinders formed in an engine block;

at least one pair of pistons each moving in a linear direction perpendicular to the inside of a respective one of said cylinders in response to energy forces in a respective chamber positioned at one end of each cylinder;

a stabilizer having a first and second end wherein each end is connected to a lower portion of each piston, said stabilizer includes a pair of gears, a respective one of said pair of gears connected to each end of said stabilizer and configured to engage each other to maintain said linear direction of movement of said pistons;

at least one pair of connecting arms each pivotally connected to a respective one of said first and second ends of said stabilizer; and a first drive shaft connected to a first connecting arm of said pair and a second drive shaft connected to a second connecting arm of said pair, wherein said first and second drive shafts transfer energy to one or more external devices, wherein said first and second ends are separated by an adjusting screw to provide alignment of said pistons.

12. The engine according to claim 11 wherein said pistons each comprise:

a top portion for transferring said energy to said stabilizer; and a ring portion for supporting one or more piston rings positioned around each piston for reducing wear between said piston and said cylinder.

13. The engine according to claim 11 wherein said energy forces are generated by combustible gas.

14. A compressor comprising:

at least one pair of cylinders formed in an engine block;

at least one pair of pistons each moving in a linear direction perpendicular to the inside of a respective one of said cylinders in response to energy forces in a respective chamber positioned at one end of each cylinder;

a stabilizer having a first and second end wherein each end is connected to a lower portion of each piston, said stabilizer includes a pair of gears, a respective one of said pair of gears connected to each end of said stabilizer and configured to engage each other to maintain said linear direction of movement of said pistons;

at least one pair of connecting arms each pivotally connected to a respective one of said first and second ends of said stabilizer; and a first drive shaft connected to a first connecting arm of said pair and a second drive shaft connected to a second connecting arm of said pair, wherein said first and second drive shafts transfer energy to one or more external devices.

* * * * *